United States Patent [19]

Mason, Jr.

[11] 3,931,948

[45] Jan. 13, 1976

[54] SUSPENSION HOLDERS FOR CONTAINERS AND OTHER ARTICLES AND BLANKS FOR FORMING THE SAME

[75] Inventor: Stanley I. Mason, Jr., Weston, Conn.

[73] Assignee: Simco, Inc., Weston, Conn.

[22] Filed: Sept. 26, 1974

[21] Appl. No.: 509,560

[52] U.S. Cl. ..... 248/318; 211/113

[51] Int. Cl.[2] ..... A61B 19/00

[58] Field of Search ..... 248/318, 359, 360; 211/113, 118; 215/100 R

[56] References Cited

UNITED STATES PATENTS

| | | | |
|---|---|---|---|
| 1,600,931 | 9/1926 | Chatham | 248/318 |
| 3,224,054 | 12/1965 | Lige | 248/74 PB X |
| 3,402,910 | 9/1968 | Purvis | 248/318 |
| 3,481,572 | 12/1969 | Casebolt et al. | 52/100 X |
| 3,630,477 | 12/1971 | Stadler | 248/318 |
| 3,865,339 | 11/1975 | Von Alven | 248/360 |

*Primary Examiner*—J. Franklin Foss
*Attorney, Agent, or Firm*—Haynes N. Johnson, Esq.; Alphonse R. Noe, Esq.

[57] ABSTRACT

A holder for supporting or carrying an article, obtained from a die cut blank of flexible sheet material such as thermoplastic sheet, may be used to prepackage containers of the throw away type in vertical stacked relationship. The holder may also serve as a convenient carrier for beverage and similar containers at the point of sale. The article holder finds further advantageous use as an effective support for balanced vertical suspension support for flower pots and similar articles. The blank may be die cut from sheet which remains flat until ready for use and may also include thermoformed portions.

7 Claims, 18 Drawing Figures

Fig. 11.
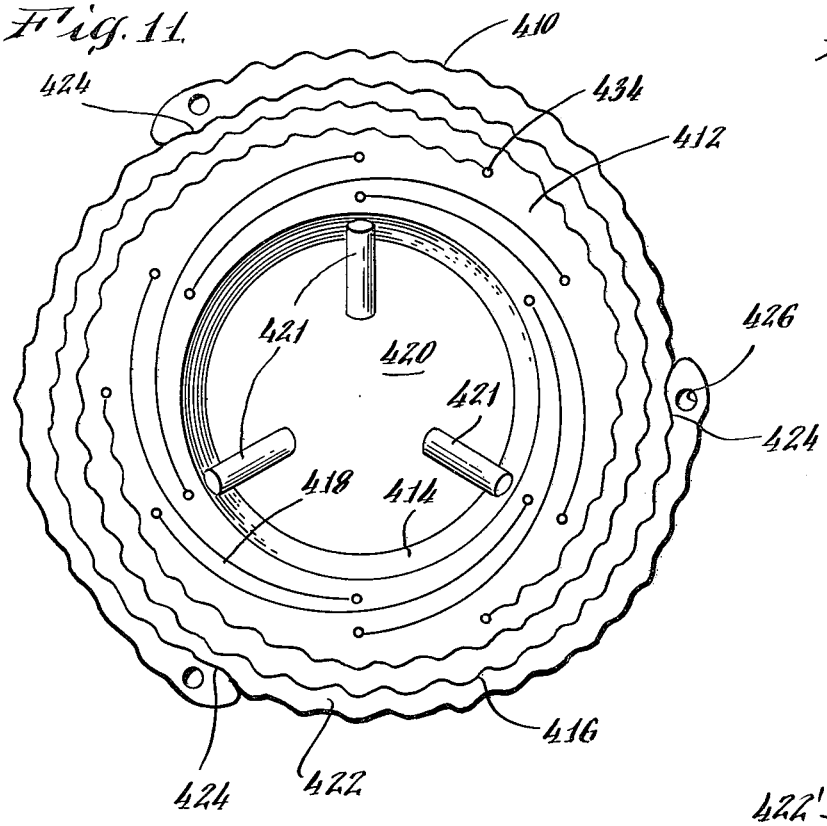
Fig. 12.
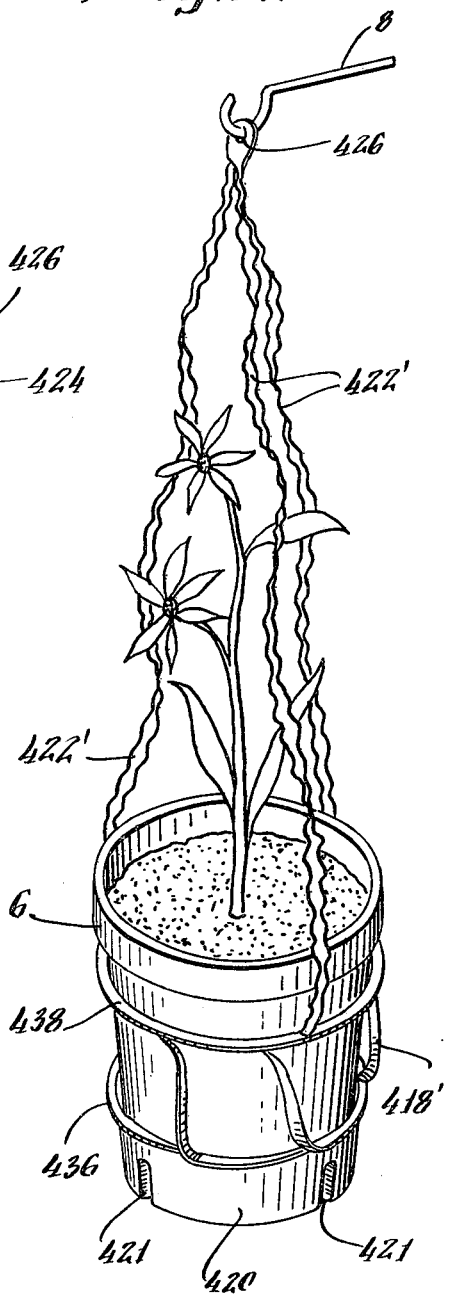
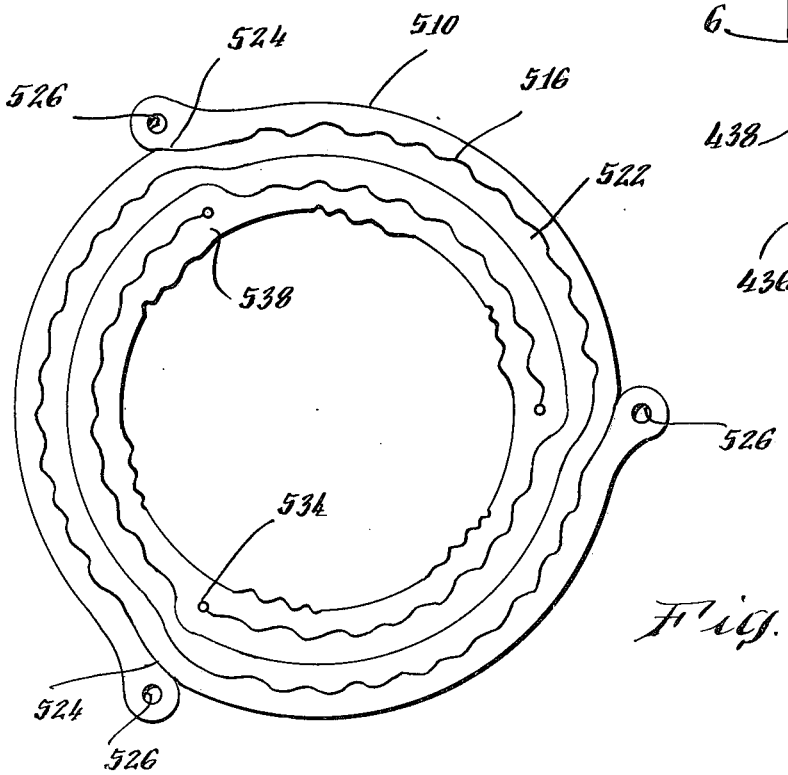
Fig. 13.

SUSPENSION HOLDERS FOR CONTAINERS AND OTHER ARTICLES AND BLANKS FOR FORMING THE SAME

BACKGROUND OF THE INVENTION

This invention relates to holders and carriers for articles such as food and beverage containers, flower pots, and the like and particularly to such which are die cut from flat sheet material and which, upon separation and extension of the cut portions, form a means for holding or carrying the articles in a balanced suspended position.

A variety of means for holding and carrying a plurality of prepackaged containers such as beverage cans and the like are known. An example of prepackaging of containers such as cans for convenient carrying is the familiar six-pack, whether it be of cardboard or of plastic sheet which is formed to fit the tops of the cans or die cut to provide collars around the cans. In addition, the use of fold out cardboard trays for convenient carrying of beverage containers such as common frustoconical throw away containers used by fast food and food take-out establishments are also known. These fold out trays either provide a typical tray configuration into which the containers are placed or contain cut out openings into which the containers may be placed for carrying several at one time. Such container holders and carriers have only limited application. Thus, the common means utilized to hold a prepackaged six-pack together is not suitable for utilization as a means for packaging together, for convenient carrying, loose containers at the point of sale. Similarly, the fold out cardboard tray has its limitations in that the use of cardboard provides a bulky unit, with concomitant expenses of manufacture, storage and transportation, possessing inherent limitations of cardboard material arising from weaknesses occuring when the material becomes wet from spillage from the containers being carried.

Many consumer items are sold in an incomplete state in that subsequent provision must be made for fully assembling the items, attaching them to a wall, providing them with a more attractive environment and the like. An example of such an item is the potted plant which, because of its popularity, is sold not only at florists but in supermarkets, department stores, drug stores, variety stores and from portable carts in shopping centers, airports, parks and other places where people are likely to assemble or pass. It is currently the vogue to attractively display plants as suspended hanging plants. However the hanging potted plant requires a suspension holder which must not only be pleasing to the eye but also must be of sufficient strength to hold the plant. Heretofore, there has not existed such a suspension holder which is both attractive and strong and economically mass produced for convenient sale along with the potted plant at the point of sale.

SUMMARY OF THE INVENTION

My invention provides an article holder and carrier which overcomes the disadvantages associated with the previously described means for accomplishing a similar purpose by providing an easy to manufacture and use carrier for carrying one or more articles, including beverage containers and the like, in a balanced substantially vertical suspension position without the need for prepackaging and with convenience of use. Specifically, my invention provides an article holder and carrier which is produced by die cutting a blank of flat sheet material, such as thermoplastic material, metal foil, paper and the like, in a manner so as to provide a support for suspending a single article, or for suspending and carrying a container upon which may be stacked several other containers.

The article holder and/or carrier may be stored as a flat sheet in its die cut condition and readily utilized by simple separation and extension of the cut portions to form a receptacle to receive the article to be held or carried. The carrier is constructed such that when a plurality of articles are to be held or carried they are placed in the carrier in stacked vertical relationship and maintained in a stable stacked position with an appropriately secure closure. Thus, the article carrier finds utility both for prepackaging items to be sold with several units contained in one prepackaged holder or carrier and for packaging loose containers into a unit carrier at the point of sale. It is also sufficiently economical to be disposable.

Accordingly, a feature of my invention is the provision of an article holder and/or carrier for substantially vertical suspension holding or carrying of containers.

A further feature of my invention is the provision of an article holder and/or carrier formed from a substantially flat die cut blank which is convenient and economical to use in a wide variety of packaging applications.

The die cut blank which is to become an article holder or carrier may take several configurations depending on the type of article to be carried and the support required. Thus, the cut out portions which support the article in suspension may be of varied configuration or thickness, for strength as well as for adaptability for receipt of the article to be supported or carried. The die cuts may be made to not only provide structural elements of the carrier but also to maximize utilization and minimize waste of the sheet material used for the blank. In addition, the blank may contain molded or thermoformed portions which become a part of the holder or carrier.

Thus, another feature of my invention is the provision of a die cut blank capable of utilization for formation into a article suspension holder or carrier.

An additional feature of my invention is the provision of a die cut blank for use as an article holder and/or carrier in which the blank material is essentially one hundred percent utilized to form the holder and/or carrier with essentially no waste.

A yet additional feature of my invention is the provision of a suspension holder for flower pots and the like.

BRIEF DESCRIPTION OF THE DRAWINGS

The foregoing advantages and features of my invention will be more apparent and better understood from a consideration of the following detailed description in connection with the accompanying drawings of an embodiment thereof in which:

FIG. 11 is a top view of a die cut and thermoformed blank suitable to form an article holder according to another embodiment of my invention;

FIG. 12 is a side view, in perspective, of the article holder formed from the blank shown in FIG. 11 showing therein a potted plant being suspension supported;

FIG. 13 is a top view of a die cut blank suitable for use as an article holder according to a further embodiment of my invention;

DETAILED DESCRIPTION OF THE DRAWINGS

Referring to FIGS. 1-4, there is shown a die cut blank 10 formed from flexible sheet material such as thermoplastic sheet, metal foil, paper or other suitable material. The die cut blank 10 includes a substantially flat sheet 12 having cuts therein, advantageously made by die cutting although other means are possible, shown generally at 14 and 16.

Figure 1:
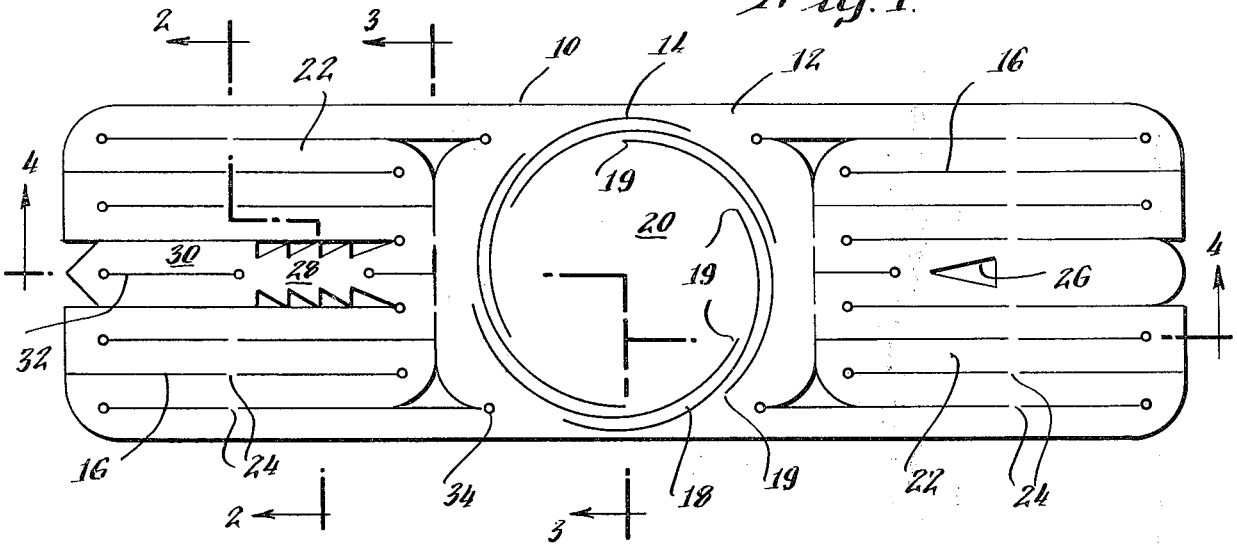
FIG. 1 is a top view of a embodiment of a die cut blank formed according to my invention.
Figure 2:
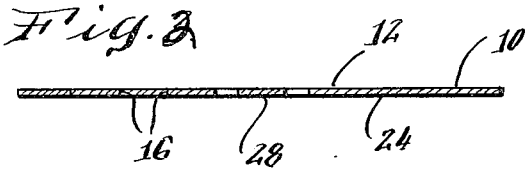
FIG. 2 is a sectional view taken along Line 2—2 of FIG. 1 showing the cuts in the blank.
Figure 3:
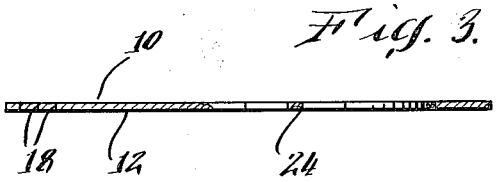
FIG. 3 is a sectional view taken along Line 3—3 of FIG. 1 showing another aspect of the cuts in the blank.
Figure 4:
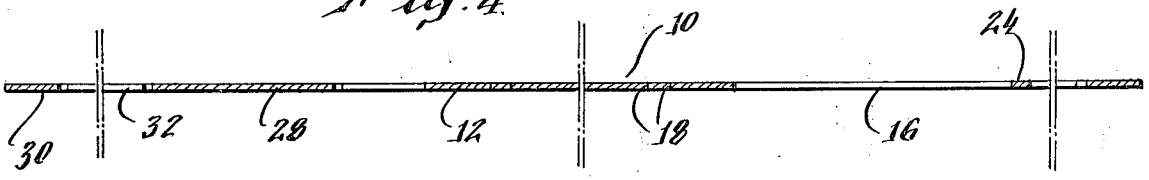
FIG. 4 is a sectional view taken along Line 4—4 of FIG. 1 also showing the cuts in the blank.

As seen in FIG. 1, the cuts 14 are arcuate concentric cuts offset from one another in the plane of the sheet 12 to define material portions 18. The terminii of the arcuate cuts 14 sufficiently overlap each other, as shown in FIG. 1, so that the material portions 18 remain secured through their ends 19 to the sheet 12 and to the blank central portion 20, an area defined generally by the arcuate cuts. The cuts 16 define material portions 22 which remain detachably secured to one another through bridges 24. The dimension of the bridges 24 is selected so that the material forming them may be severed or broken upon application of hand pressure. The manner in which the described cuts and material portions cooperate to form an article holder and/or carrier with a specific support structure will be described in greater detail hereinafter with reference to FIGS. 5, 9, and 10.

Also seen in FIG. 1 as a part of the die cut blank 10 is a opening 26, which may also be formed by die cutting and a toothed closure means 28 having a tab 30 within which is a cut 32 which defines a hole for carrying or supporting the article holder. To facilitate separation of material portions, such as these indicated at 18 and 22, and cutting of the blank there may be provided holes, shown at 34, at the terminus of each cut. These holes 34 minimize tearing of the sheet material at the ends of the cuts, also.

Figure 5:
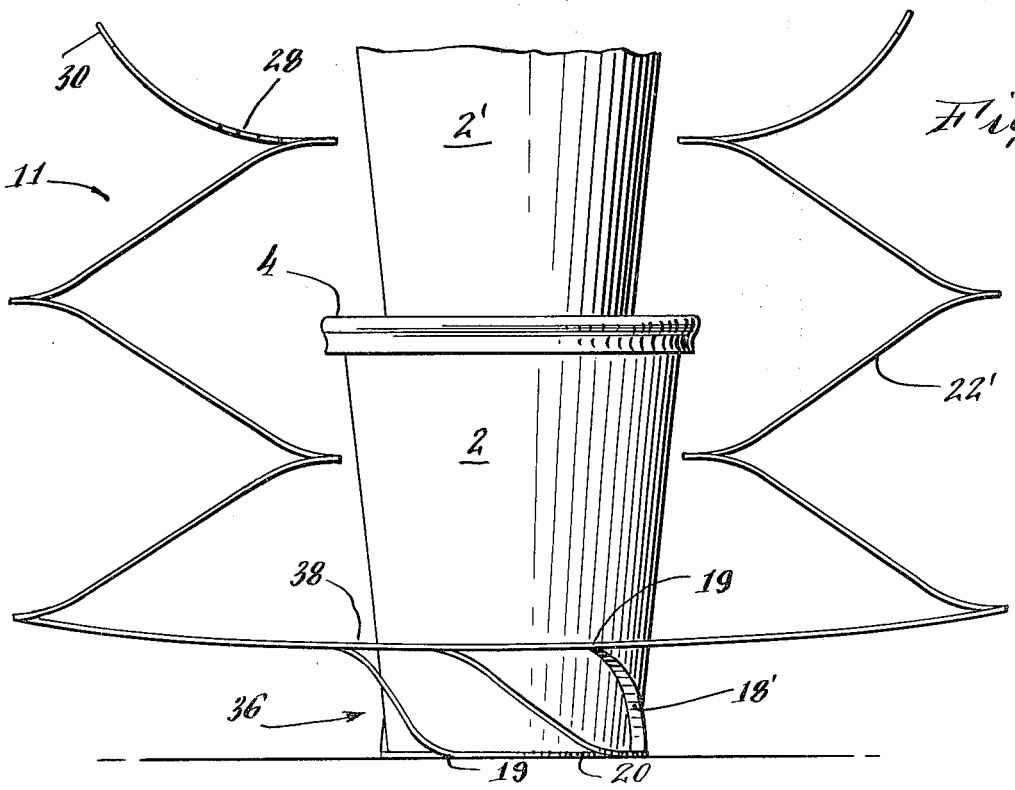
FIG. 5 is a side view of an expansion of the blank shown in FIG. 1 to form a container carrier for the cups shown.

Referring now to FIG. 5, there is seen an article carrier 11 formed by separation and extension of the cut portions of the die cut blank 10 of FIG. 1. FIG. 5 shows the die cut blank 10 partially extended for the reception of a container 2, such as a frustoconical throw away beverage cup. The container 2 may have a lid 4 upon which is stacked a like container 2'. To support or carry the containers, the bottomost container 2 is placed in the center of the die cut blank on the central material portion 20 which then becomes the bottom support means 20' of the article carrier 11. The material portions 18 formed by the cuts 14 extend from the bottom support means 20' and provide upwardly extending vertical side restraining or support means 18'. The side restraining means 18' together with the bottom support means 20' define a receptacle indicated generally at 36 for receipt of at least a portion of the container 2.

The material of the sheet 12 forming the region between the area of die cuts 14 and 16 forms, upon separation and extension of the cut portion, a peripheral collar-like means 38. Extending from this collar-like means 38 are the material portions 22 defined by the cuts 16. These material portions 22 provide, upon separation from one another and extension, vertical longitudinal posts 22' which provide expandable side supports for the container 2 and those stacked upon it. The posts 22' surround the plurality of containers and enclose them therein, and also provide suspension support therefor as will be described in greater detail hereinafter with reference to FIGS. 9 and 10.

Figure 9:
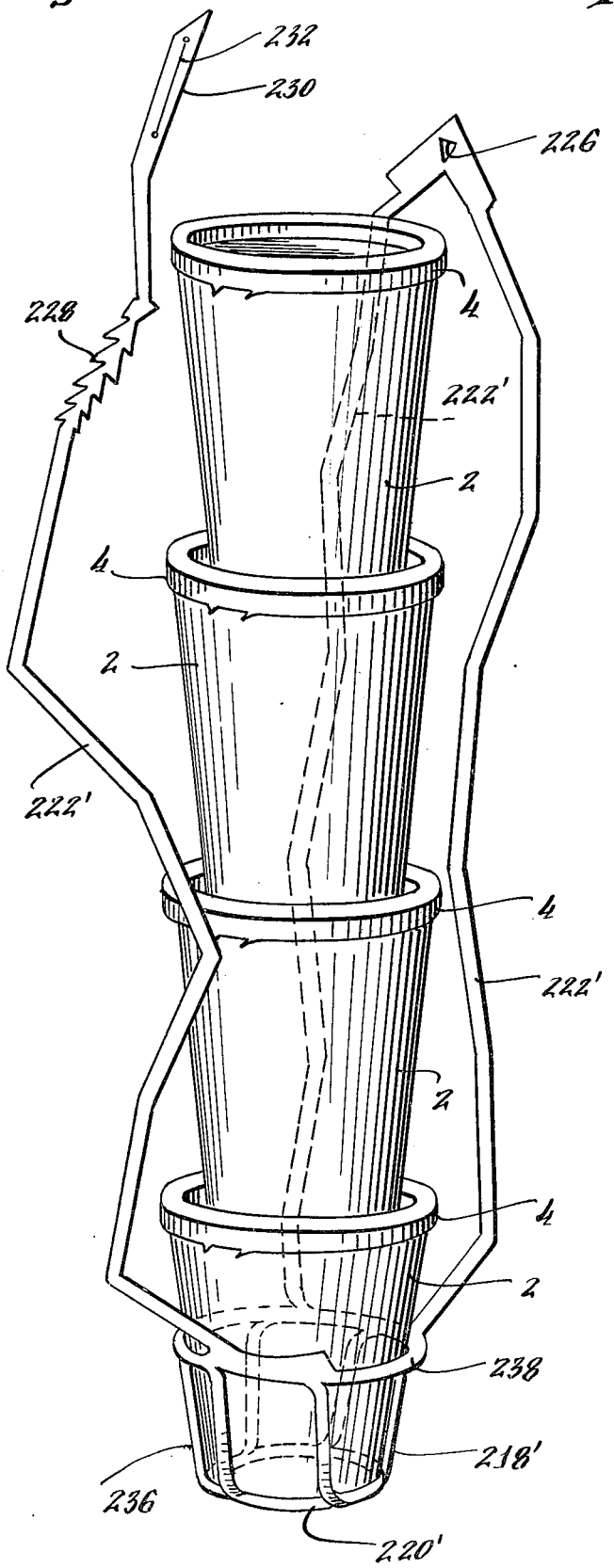
FIG. 9 is a side view, in perspective, showing the blank of FIG. 7 with its cut portions separated and extended for use as an article carrier for the stacked container shown.
Figure 10:
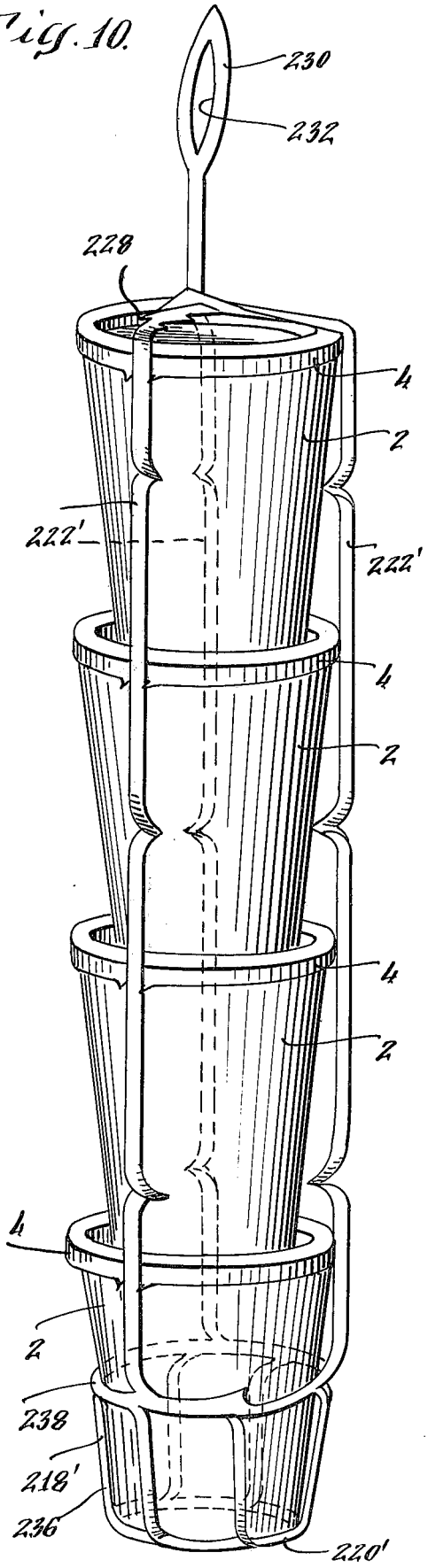
FIG. 10 is a view similar to that of FIG. 9 except that the container carrier is fully extended in surrounding the containers and is secured to firmly maintain the containers in a stable position therein.

FIGS. 9 and 10 show an article carrier expanded from a die cut blank of a type similar to the die cut blank 10 shown in FIG. 1. However, while the die cut blank 10 of FIG. 1 will, upon separation and expansion of the cut portions 22, have four posts 22', the article carrier shown in FIGS. 9 and 10 has only three posts. Such an article carrier 211 is formed from a die cut blank 210 as shown in FIG. 7.

Figure 7:
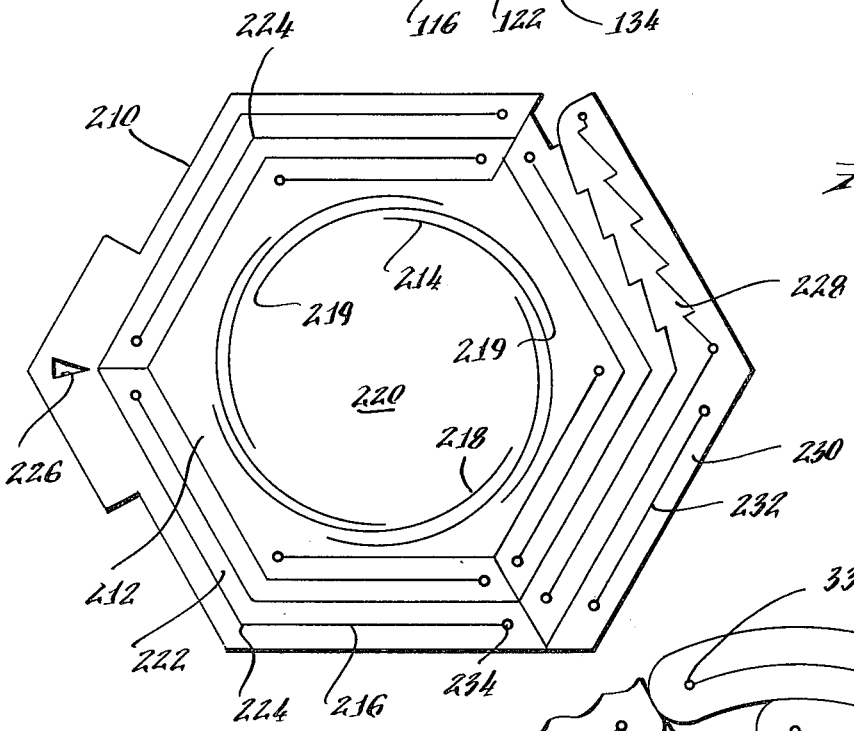

The die cut blank of FIG. 7 is similar to that of FIG. 1 with the exception that, upon separation and expansion, three posts 222' are formed. The blank configuration and cuts formed are also somewhat different although they function in a similar manner to provide a similar result. Similar parts of the blanks are identified with similar numerals except that the identifying numerals of FIG. 7 are in the 200 series. While the die cut blank 10 of FIG. 1 is provided with bridges of material 24 to connect the cut portions until such time as they are to be separated and extended for use, the blank 210 of FIG. 8 maintains the blank in flat form until used as a carrier by having incomplete cuts at the apex of the angular cuts 222 as shown at locations 224.

Figure 6:
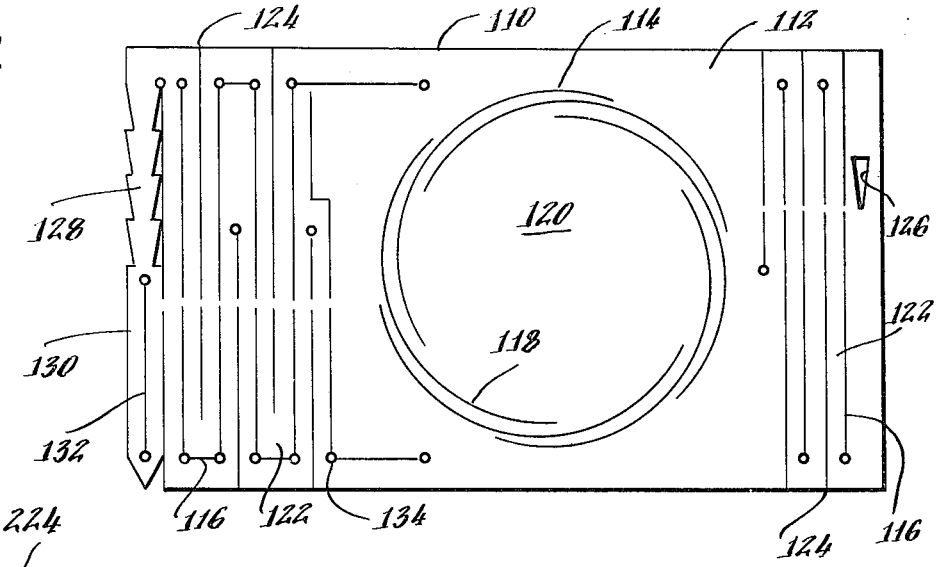
FIGS. 6, 7, 8 are top views of further embodiments of die cut blanks according to my invention.

FIG. 6 shows another embodiment of a die cut blank which results in a three post article carrier when separated and expanded. The numerals indicating the various parts of the blank of FIG. 6 correspond to those previously used to identify similar parts except that they are of the 100 series. To maintain the die cut blank 110 in sheet form until ready for use as a carrier incomplete cuts are provided at various locations including along the center line through the central portion 120 and the material portions 122 and at the cut ends as shown at 124 in FIG. 6.

Figure 8:
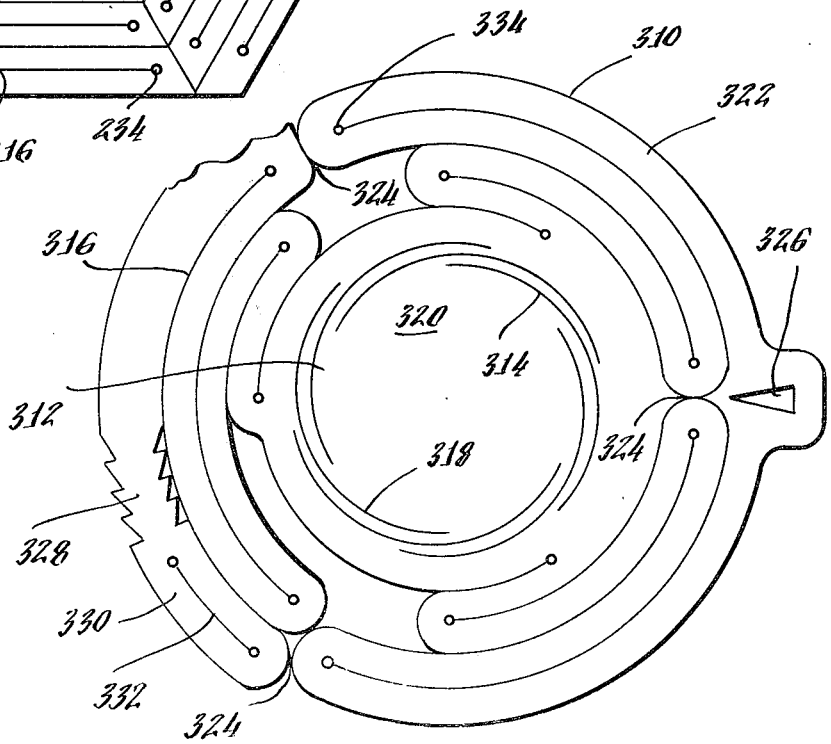

FIG. 9 shows yet another embodiment of a die cut blank 310 which upon separation of the cut portions and extension provides a three post carrier for containers. The expansion is similar to that shown in FIGS. 9 and 10 and parts similar to the other blanks of FIGS. 1, 6 and 7 are identified by similar numerals with the exception that those of FIG. 8 are of the 300 series. To maintain the die cut blank 310 in flat condition until used, incomplete cuts are made at locations such as shown at 324.

The illustration in FIG. 5 shows the expansion of the die cut blank 10 of FIG. 1 while FIGS. 9 and 10 illustrate the expansion, into a article carrier, of the die cut blank 210 of FIG. 7. However, it is to be understood that the blank embodiments shown in FIGS. 6 and 8, die cut blanks 110 and 310, function in a similar manner to that illustrated in FIGS. 5, 9 and 10 to contain and carry containers and other articles.

As seen in FIGS. 9 and 10, the posts 222′ may be tightly placed around the plurality of containers 2 to maintain them in a tight, stacked, unspillable relationship by detachably securing the posts to one another through means of the toothed closure means 228. The toothed closure means 228 is passed through the closure opening 226 and twisted so that the teeth engage it and maintain it from opening. The cut 232 may define a opening 232′ for use as a finger hole for carrying the containers 2 or for hanging then on a hook for storage. The parts 222′ provide balanced vertical suspension of the articles while the receptacle means, shown generally at 236, through its bottom support means 220′ provides the bottom support. The receptacle means is defined by the bottom support means 220′, the upright side restraining means 218′ and the peripheral or annular collar-like means 238. The upwardly extending posts 222′ also provide side supports for the stack of articles.

The embodiments of die cut blanks illustrated in FIGS. 1 through 4 and 6 through 8 and the article carriers formed therefrom, shown in FIGS. 5, 9 and 10, are particularly useful for holding and carrying beverage containers of the throw away type utilized by fast food and food take out establishments. As shown, the carrier readily carries cups, such as the illustrated six-ounce size, up to four in each holder. However, it will be understood by those skilled in the art that the dimensions of the blank may be varied to form a article carrier that is suitable for different sizes and types of containers. For example, it is contemplated that blanks forming carriers of the types described may be utilized for prepackaging several units as is now done for six-packs, with the exception that now a vertical six-pack is available which will facilitate stacking in stores and handling by the consumer. Not only may the size and configuration of the die blank vary within my teaching but also its thickness to suit the particular purpose. A suitable material for light duty carrying such as the cups shown may be a medium density polyethylene of 0.015 inches thickness. The several embodiments shown here illustrate the wide applicability of my teaching to various equivalents.

FIGS. 11 through 14 illustrate an embodiment of the invention providing utility as a holder for potted plants and the like. Referring to FIG. 11, there is shown a die cut and thermoformed blank 410 including a sheet 412 having die cuts 414 and 416 in a manner similar to those in the blanks previously described. The die cuts 414 and 416 define material portions 418 and 422 respectively. The blank central portion 420, instead of constituting flat sheet material as with the blanks previously described, is thermoformed such as by vacuum forming or otherwise molded by known means to form a cup-like depression. The cup-like portion 420 is illustrated in perspective in the view of FIG. 12 where it is shown forming a receptacle, shown generally at 436, together with the upwardly extending vertical side support mean 418′ formed from the cut and separated material portions 418 of the blank 410 of FIG. 11. The cup may contain ridges molded therein for support and stability as shown at 421. Holes identified at 434 are provided to avoid tearing of the material at the terminii of the cuts while incomplete cuts may be made at various locations, such as at 424, to maintain the blank in unopened position until ready for use. Additional holes 426 may be provided as a means for supporting the container holder, as for example on a hook.

FIG. 12 shows the die blank of FIG. 11 with cut portions separated and expanded to provide a pot holder for a pot 6. The portions 422 formed by the die cuts 416 become posts 422′ which permit balanced suspension support of the pot from a hook 8 by means of the openings 426. The portions 418 defined by the cuts 414 provide upright means 418′ extending upwardly from the thermoformed cup 420 forming a receptacle and support for the pot 8. The cup portion 420 assures that the pot is securely supported and advantageously provides a container for water and the like.

FIG. 13 illustrates an embodiment, similar to that shown in FIG. 11, suitable for expansion into a pot holder. The die cut blank 510 of FIG. 13 contains no center portion as did the other blanks but rather includes a center opening defined by the annular collar-like rim 538. The die cuts 516 define material portions 522 which upon separation and expansion become posts 522′ similar to those shown at 422′ in FIG. 12. As an alternative to the bottom support of the embodiments previously described, the article holder expanded from the die cut blank 510 merely seizes a tapered pot with a peripheral collar 538 similar to the collar 438 shown in FIG. 12, and suspends it freely with no bottom support. The remainder of the blank 510 is similar to the embodiment of FIG. 11 and similar numerals identify similar parts except that those in FIG. 13 are of the 500 series.

Figure 14:
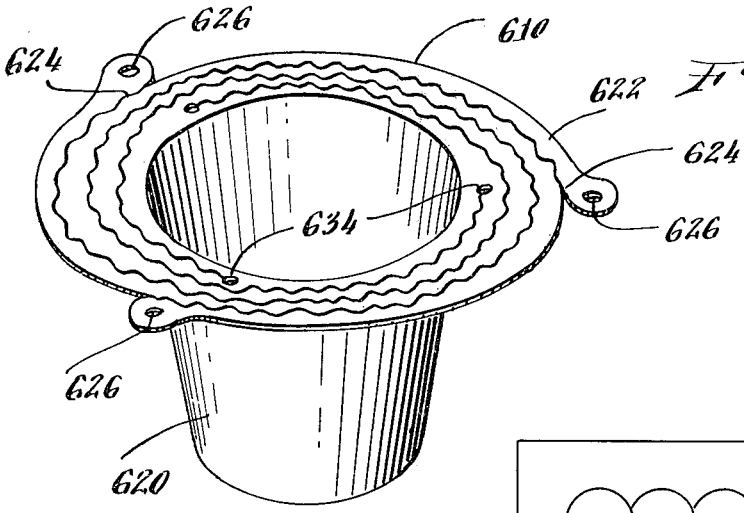
FIG. 14 is a side view, in perspective, of a die cut and thermoformed blank suitable for use as a flower pot holder.

FIG. 14 shows a further embodiment of a blank which may be utilized as a container holder which is also similar to that shown in FIG. 11. In FIG. 14, the die cut and thermoformed blank 610 has as the entire center portion 620 a thermoformed cup and no die cut portions except for those which will form posts for suspension support. The portions 622 formed by the die cuts 616 provide posts, similar to those shown as 422′ in FIG. 12, upon separation and extension of the cut material. In other respects, the embodiment of FIG. 14 is similar to that shown in FIG. 11 and identifying numerals are similar with the exception that those in FIG. 14 are of the 600 series.

Figure 15:
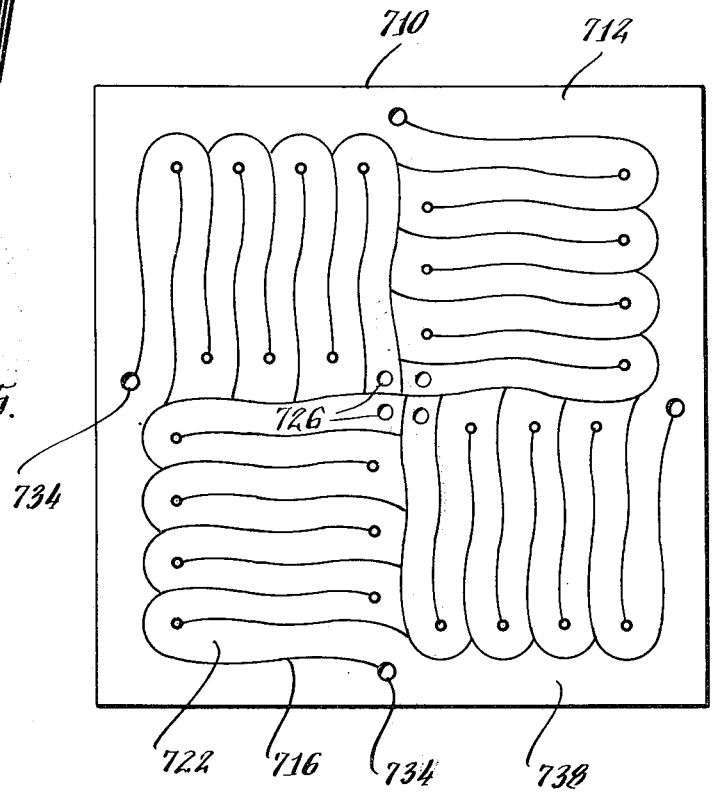
FIGS. 15, 16, 17 are top views of further embodiments of die cut blanks suitable for use as article holders and/or carriers and in which the use of material is maximized and waste minimized.
Figure 16:
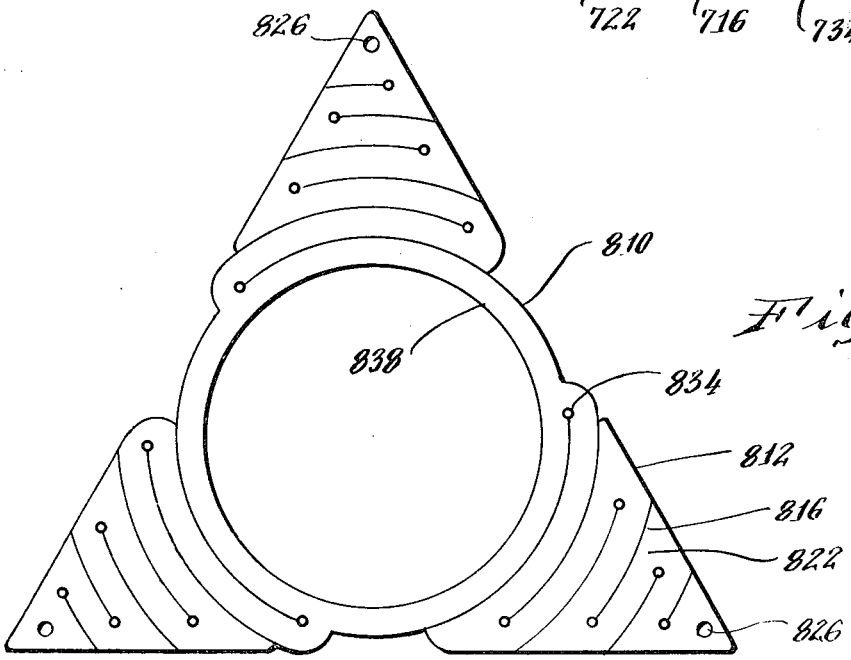

FIGS. 15 and 16 show embodiments of die cut blanks which upon separation and extension of cut material provide convenient and attractive article holders, such as for potted plants, as well as carriers for other containers. Referring to FIG. 15, there is shown a die cut blank 710 having cuts 716 formed on a sheet 712. The cuts define material portions 722 which, upon separation and extension, correspond to the suspension posts described for the other embodiments. As shown in FIG. 15, the cuts 716 are in a series, each of which is contained in one quarter of the rectangular blank so that there will be formed four individual posts. The article is supported by the peripheral collar-like support means 738 in a manner similar to that for the embodiment of FIG. 13. The die cut blank 710 is particularly advantageous in that it makes a highly efficient use of material and eliminates the problems of waste since material is essentially 100 percent utilized. The removal of the portions 722 to form the posts leaves the center opening which receives the article within the collar-like support means 738. Holes at the terminii of cuts are shown at 734. As previously described, bridges or incomplete cuts may be provided to maintain the blank flat until ready for use.

FIG. 16 illustrates a die cut blank 810 which, upon separation and extension of the cut material, as previously described, provides an article holder which holds the article in its center opening defined by the collar-like annular peripheral rim 838. The die cuts 816 in sheet 812 define material portions 822 which form the posts for suspension support of the article.

Figure 17:
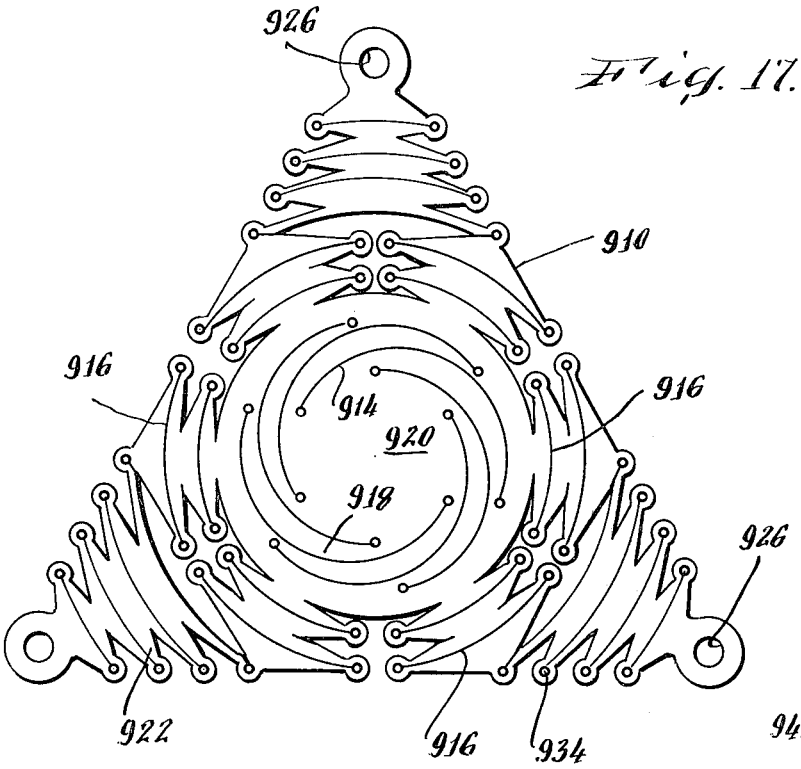
Figure 18:
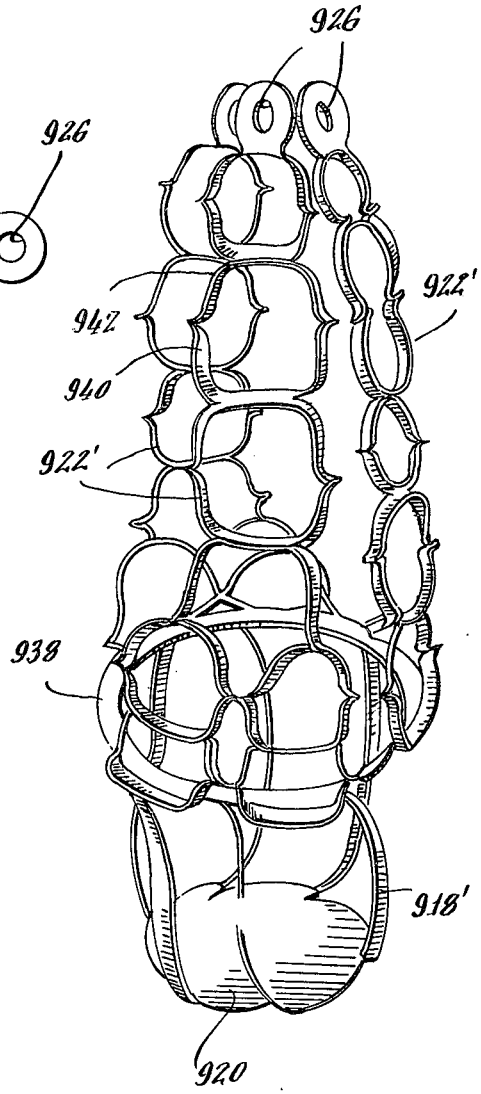
FIG. 18 is a side view, in perspective, of an article holder formed from the die cut blank shown in FIG. 17.

FIG. 17 shows a die cut blank 910, similar to those previously described, having a center portion 920 and die cuts 914 and 916 which define material portions 918 and 922. Referring to FIG. 18, it can be seen that the center portion 920 provides a bottom support for an article such as a flower pot while the cut material portions 918 become upright supporting wall means 918'. The posts 922' shown in FIG. 18 are formed from the material portions 922 formed by cuts 916. However, the embodiment of FIGS. 17 and 18 differs from those previously described in that the posts 922' are not mere longitudinal extensions but rather the die cuts are made, as illustrated in FIG. 17, to provide a chain link-like structure with individual links 940, seen in FIG. 18, joined at areas 942. This provides increased strength for support of the pot without detracting from the appearance of the holder and without the need for extra thick material, thus increasing economy.

I claim:

1. An integral substantially flat, cut sheet article holder capable of supporting at least one or more articles in balanced vertical suspension upon separation and extension of cut portions, comprising an integral flat flexible sheet, a center portion of the sheet having a plurality of arcuate cuts, the arcuate cuts being located in an area which defines generally an annular circumferential region, the arcuate cuts being offset from one another within the annular region in the plane of the flat sheet, cuts of each arcuate cut overlapping at least two other arcuate cuts so as to define upon separation of cut portions and extension from the flat sheet a receptacle-like portion having a bottom support means, a peripheral collar-like portion and upright side support portions secured through one of their respective ends to the bottom support means and through the other of their respective ends to the collar-like portion, the flat sheet material surrounding the annular circumferential region being further cut with a plurality of a series of cuts offset from one another in the plane of the flat material but partially overlapping in an alternate reverse cut manner to define, upon separation of the material at the cuts and extension thereof, a plurality of post-like extension portions integral with the receptacle-like portion, the portions of the sheet defined by the cuts being substantially contiguous when the flexible sheet is in flat condition so that essentially all the material of the sheet is utilized in the holder.

2. An article holder as claimed in claim 1 wherein the receptacle means is a thermoformed container and the post means are die cut from flat flexible sheet material surrounding the container opening.

3. An article holder as claimed in claim 1 wherein the post-like extension portions include securing means for detachably securing the upper ends thereof together to provide one common location for support of the article holder.

4. An article holder as claimed in claim 1 wherein the cut portions are connected to one another at selected locations by bridge means severable under the influence of pressure of a magnitude no greater than that which can be applied by hand so as to maintain the cut sheet in substantially flat position until ready for separation of cut portions and extension to form the holder.

5. An article holder as claimed in claim 1 wherein the bottom support means comprises a flat, horizontal portion.

6. An article holder as claimed in claim 1 wherein the bottom support means comprises a cup-like container portion.

7. An article holder as claimed in claim 1 wherein the receptacle-like portion is configured to be capable of receiving at least a part of the bottommost container in a stack of containers, the plurality of post-like extension portions extend vertically upward from the collar-like means for enclosing therebetween the containers of the stack located on top of the bottommost container and a securing means is provided on the post-like extension portions for detachably securing the upper ends thereof together to form a secure enclosure about the container stack and carrying means in at least one of the post means for convenient suspension carrying of the entire stack from one location.

* * * * *